US007503641B2

(12) United States Patent
Nino

(10) Patent No.: US 7,503,641 B2
(45) Date of Patent: Mar. 17, 2009

(54) INK JET PRINTING APPARATUS HAVING A PROGRAMMED CONTROLLER THAT MINIMIZES BANDING ARTIFACTS

(75) Inventor: Cesar Leonardo Nino, Newark, DE (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 11/820,888

(22) Filed: Jun. 21, 2007

(65) Prior Publication Data

US 2008/0316259 A1 Dec. 25, 2008

(51) Int. Cl.
*B41J 2/15* (2006.01)
*B41J 2/145* (2006.01)

(52) U.S. Cl. ..... 347/41; 347/15

(58) Field of Classification Search ..... 347/9, 347/12, 15, 41

See application file for complete search history.

(56) References Cited

U.S. PATENT DOCUMENTS 5,625,389 A 4/1997 Eriksen et al.

OTHER PUBLICATIONS

Carl De Boor, Best Approximation Properties of Spline Functions of Odd Degree, J. Mech. Math 12, pp. 747-749, 1963.
Carl De Boor, Calculation of the smoothing spline with weighted roughness measure, as appearing in Math. Models Methods appl. Sci. 11(1) pp. 33-41 2001.
G. Micula, A Variational Appraoch to Spline Functions Theory, Rend. Sem. Mat. Univ. Pol. Torino, 61, pp. 209-227, 2003.
I. J. Schoenberg, Cardinal Interpolation and Spline Functions, Journal of Approximation Theory 2, pp. 167-206, 1969.

*Primary Examiner*—Thinh H Nguyen

(57) ABSTRACT

A multipass printing apparatus is characterized by a computer-implemented controller that controls printing operation so that, on any given pass, the number of selected print locations onto which printing ink is deposited by each of N nozzles varies from nozzle to nozzle. The variation is governed in accordance with a weighted smoothing spline function, particularly a polynomial B-spline function of the order "j", where j is a value equal to one less than the number of passes.

4 Claims, 12 Drawing Sheets

INK JET PRINTING APPARATUS HAVING A PROGRAMMED CONTROLLER THAT MINIMIZES BANDING ARTIFACTS

FIELD OF THE INVENTION

The present invention relates to an ink jet printing apparatus controlled by a programmed controller to operate in a manner that reduces banding artifacts produced by errors introduced when the substrate being printed is moved under the print head.

CROSS REFERENCE TO RELATED APPLICATIONS

Subject matter disclosed herein is disclosed and claimed in the following copending applications, both filed contemporaneously herewith and both assigned to the assignee of the present invention:

A Method For Minimizing Banding Artifacts In An Ink Jet Printing Apparatus (IJ-225); and Computer Readable Medium With A Program For Minimizing Banding Artifacts In An Ink Jet Printing Apparatus (IJ-0228).

DESCRIPTION OF THE PRIOR ART

FIG. 1 is a stylized pictorial representation illustrating the basic mechanical elements of a large format ink jet printing apparatus generally indicated by the reference character 10 from which may be understood the rudiments of the print operation and the origin of the problem of banding. Representative of such a class of ink jet printing apparatus is that device sold by E.I. du Pont de Nemours and Company as the Chromaprint® printer. It should be understood, however, that the teachings of the present invention apply to any ink jet printing apparatus capable of multipass operation that has a controller software interface that allows allocation of printing locations among print nozzles.

In general, the ink jet printing apparatus 10 includes a framework 12 that supports both a media substrate transport arrangement generally indicated by the reference character 14 and a print carriage generally indicated by the reference character 16.

The media substrate transport arrangement 14 serves to carry a media substrate S along a path of travel 18 extending through the apparatus 10. As seen from FIG. 1 the path of travel 18 aligns with the Y-axis of a reference coordinate system 20. The direction of the positive Y-axis is usually referred to as the "vertical" direction. The media substrate transport arrangement 14 may be implemented by any suitable mechanical expedient, such as pinch/drive roller drive or an endless conveyor belt, as broadly suggested in FIG. 1. However implemented the transport arrangement 14 is driven by any suitable drive motor 14M, such as a stepper motor, operated under the control of a printer control computer 22. A transducer 14T returns information regarding the vertical location of the substrate S along the path of travel 18 to the printer control computer 22.

To prevent any relative movement between the substrate S and the transport the surface 14F of the transport may be foraminous and the interior of the transport evacuated by a vacuum pump (not shown). This suction action serves to hold the substrate S tightly to the surface 14F of the transport.

The print carriage 16 includes a platform 16P that is mounted through a flange 16F to a guide rail 16R that is itself supported by the frame 12. The guide rail 16R is broken away for clarity of illustration. The print carriage 16 is displaced along the drive rail 16R in reciprocating "horizontal" directions transverse to the path of travel (i.e., in positive and negative directions along the X-reference axis) by a suitable drive arrangement 16D. A typical drive arrangement 16D, as suggested in FIG. 1, includes an endless belt 16B (also broken for clarity) driven by a drive motor 16M. Movement of the platform 16P is governed by the printer control computer 22 and information regarding the horizontal position of the platform 16P is returned to the computer 22 from a transducer arrangement 16T.

The platform 16P carries a plurality of print heads 28. In the most basic typical case for a color printer at least four print heads K, C, M and Y, are carried on the platform, with one print head being allocated for each of the basic ink colors (black, cyan, magenta and yellow, respectively). Printing ink is supplied from a supply reservoir (not shown) to its respective print head 28 through suitable supply connections (also not shown).

Each print head 28 has an array of N number of openings, or "nozzles", generally indicated by the reference character 30. Each nozzles is identified by the reference character 30 and an index number appended as a suffix, thus: 30-1, 30-2, . . . 30-*n*, . . . 30-N. The physical length dimension of print head 28 measured in the Y-direction between the first nozzle 30-1 and the last nozzle 30-N is indicated by the reference character $L_H$. The nozzles 30 are equally spaced along the length $L_H$ of the print head 28 in which they are provided. Adjacent nozzles are equi-distantly spaced from each by a predetermined spacing distance $D_N$ (also measured in the Y-direction) (see also, FIG. 2A). The spacing $D_N$ between nozzles defines the native resolution of the print head.

Within each print head 28 a piezoelectric element (not shown) is disposed over each nozzle. Triggering pulses for each piezoelectric element are provided by a print driver 32. When a triggering pulse is applied to a piezoelectric element that element deforms and, in hammer-like fashion, forces a drop of ink through the nozzle.

The print driver 32 is operated under the control of the control computer 22. The program for the control computer is stored on a computer readable medium 22P. Raw image information (e.g., a digital photographic image) is converted by a halftone generator 22H into binary data representing those locations on each line of the substrate that are to receive drops of ink. The binary image data are combined in a gate 22G with a binary mask signal output from a mask generator 22M. The mask signal controls the locations on a scan line that receive ink on each pass of the print head to render a printed image on the substrate. Printing information passing through the gate 22G is applied to a print controller 22C. The print controller 22C generates drive signals which are applied to the print driver 32 and which, in turn, actuate the piezoelectric element in each print head. The print controller 22C also provides the control signals that govern the advance of the substrate S along the path of travel as well as the horizontal speed of the print carriage across the substrate.

Although well understood a brief discussion of the basic operation of the ink jet printer is appropriate. The transport 14 incrementally advances the substrate S to sequential positions of repose along the path of travel. Each position of repose along the path of travel defines a printing position $Y_P$ relative to the Y-axis. The usual magnitude of each incremental advance is the length $L_H$ of the print head.

With the substrate S located at a given printing location $Y_P$ the print carriage 16 is traversed across the substrate S. As the carriage traverses the substrate S each nozzle in each print head passes along a respective horizontal scan line "L" defined on the substrate. Thus, as seen in FIG. 1, at each printing position $Y_P$ each of the N number of nozzles in the print head addresses (i.e., passes over) a linear array of potential print locations disposed along a respective one of a corresponding plurality of scan lines L on the substrate S. As each nozzle moves along its scan line a drop of ink is deposited onto each printing location in accordance with the gated image data.

As noted earlier the native resolution of the printer in the vertical direction is determined by the spacing $D_N$ between adjacent nozzles. However, higher resolutions may be achieved using a technique called "multipass" or "interlace". In multipass printing the total number N of nozzles is subdivided into an integer number $P_V$ of nozzle groups and the print head makes a number $P_V$ of traverses across the substrate. This increase the vertical resolution print head.

If the original native print head resolution is denoted by $R_N$ and if the desired printing resolution is denoted as $R_D$ then the integer number $P_V$ of equal-number nozzle groups into which the nozzles are divided and the corresponding number of vertical passes is given by the relation:

$$P_V = R_D / R_N$$

For example, if the native resolution $R_N$ is 100 drops-per-inch and the desired resolution $R_D$ is 300 drops-per-inch, then the nozzles are subdivided into three groups (300/100=3) and three vertical passes $P_V$ are made across the substrate. At each location the substrate is printed using all nozzles and after each pass the substrate is advanced a distance $A_V$ in the vertical direction. The magnitude of the vertical advance distance $A_V$ in a Y-interlace operation is given by the relation:

$$A_V = i \cdot \frac{D_N \cdot N}{P_V} - Y_O \tag{1}$$

where i is the count index of the number of passes over the image, with i=0, 1, 2, . . . $P_V$; and where $Y_O$ is an offset term that places the nozzles slightly delayed every time, thus achieving higher printing resolution:

$$Y_O = i \cdot \frac{\mathrm{Mod}(i, P_V) \cdot D_N}{P_V} \tag{2}$$

Multipass printing works extremely well as long as the print head and the nozzles operate properly. However, nozzles are susceptible to clogging. If a nozzle is clogged the print locations on the scan lines addressed by that nozzle are left unprinted. This causes an artifact called "banding" to appear on the printed image. The term "banding" characterizes any of a class of quasi-random artifacts that are manifested as a fairly regular line pattern with periodicity substantially equal to the length of the printing bands. These errors are described as "quasi-random" because the error is random in the sense that the identity of the defective nozzle at the start of every print task is unknown, but the error remains constant for the duration of the print task. That is, a given clogged nozzle remains clogged throughout the print task. This imparts periodicity to the banding.

One method of lessening banding due to a clogged nozzle is to use the multipass technique to increase the resolution in the horizontal direction. Using multipass horizontally, also known as "X-interlace", decreases the probability that a line in a printed image will be left unprinted due to a defective nozzle because more than one nozzle addresses the print locations on the same given scan line.

In a horizontal multipass operation the print head passes a number of times $P_H$ across the substrate, where $P_H$ is an integer greater than one (i.e., $P_H>1$). $P_H$ denotes the number of times that print locations on a given scan line are addressed by one of the nozzles in the print head. The number N of available nozzles in the print head is again subdivided into $P_H$ number of groups. Each group includes an equal number of nozzles. Thus, to implement both a vertical and a horizontal multipass the N nozzles on the print head are divided into $(P_V \times P_H)$ equally-numbered groups, i.e., number of nozzles N is a multiple of $(P_V \times P_H)$.

In a horizontal multipass operation the relationship for advance distance [Equation (1)] is modified as follow:

$$A_V = i \cdot \frac{D_N \cdot N}{P_V \cdot P_H} - Y_O \tag{1A}$$

and on each scan the nozzles are offset by an X-offset $X_O$ distance defined by the relationship:

$$X_O = i \cdot \frac{\mathrm{Mod}(i, P_H) \cdot D_X}{P_V} \tag{3}$$

where $D_X$ is the horizontal distance on a scan line between interlaced ink drops.

FIGS. 2A through 2F comprise a series of diagrammatic illustrations showing a simplified hypothetical example in which printed drops are laid onto a substrate using a simple horizontal multipass technique in which each scan line is addressed by two different nozzles (i.e., $P_H=2$).

For simplicity the action of only one print head is illustrated and discussed. In addition, for simplicity and without affecting the generality of the discussion the vertical Y-interlace value $P_V$ is assumed to be one ($P_V=1$). In this example the print head has four nozzles, respectively denoted by nozzle indices "30-1", "30-2", "30-3" and "30-4". If the overall length of the print head (from first to last nozzle) is $L_H$, since the number of horizontal passes $P_H=2$ the print head is subdivided into two nozzle groups with the length of each group being $L_H/2$ units.

The substrate has a width dimension "W" and the print head has a resolution of ten drop locations-per-width W (i.e., 10 "dpW"). For this discussion it is assumed that the printed region of the substrate is to solid, i.e., filled completely. The print control computer 22 uses a mask such that nozzles 30-4 and 30-3 deposit ink at the even-numbered printing locations on a scan line while odd-numbered printing locations on a scan line receive ink deposits from nozzles 30-2 and 30-1, respectively.

It should be understood that for clarity of illustration each individual ink drop illustrated in FIGS. 2A through 2F is labeled with an alphabetic-numeric identifier indicating both the nozzle producing the drop and the horizontal pass on which the drop is produced. Drops from the nozzles 30-1 through 30-4 are indicated by the letters "A", "B", "C" and "D", respectively. Thus, for example, the identifier "$B_5$" indicates a drop produced by the nozzle 30-2 on the fifth horizontal pass.

In the initial printing position $Y_1$ (FIG. 2A) the leading edge of the substrate aligns with the forward edge of the print head. On the first pass of the print head across the substrate each nozzle deposits ink on printing locations on a respective scan line. Notice that the ink drops deposited on each scan line are spaced apart as determined by the 10' mask applied to the printer driver. The nozzles "30-4" and "30-3" deposit ink at the even-numbered printing locations on scan lines $L_1$ and $L_2$, respectively, while the nozzles 30-2 and 30-1 deposit ink at odd-numbered printing locations on scan lines $L_3$ and $L_4$, respectively. On the first pass of the print head the available printing locations on all of the lines $L_1$ through $L_4$ are only partially filled.

FIG. 2B shows the substrate advanced by the transport along the path of travel to a printing position $Y_2$. The magnitude of the advance is equal to the length of the nozzle group, viz., $L_H/2$ units. Note that the effect of this incremental advance is to displace scan lines $L_1$ and $L_2$ beyond the print head.

At printing position $Y_2$, as the print head moves across the substrate, each nozzle deposits ink on printing locations on a respective scan line as determined by the mask. Notice that on this pass the odd-numbered printing locations on scan lines $L_5$ and $L_6$ receive ink deposits from nozzles 30-2 and 30-1, respectively, partially filling the available printing locations on these lines. However, notice also that the even even-numbered printing locations on scan lines $L_3$ and $L_4$ receive ink from nozzles 30-4 and 30-3, respectively. The deposition of ink from nozzles 30-4 and 30-3 has the effect of completing (i.e., completely filling) all available printing locations) on these scan lines. Scan line $L_3$ has been totally filled by ink from nozzles 30-2 and 30-4, while scan line $L_4$ has been totally filled by ink from nozzles 30-1 and 30-3.

The situation after the substrate is advanced (by the length of a nozzle group) to the printing position $Y_3$ is illustrated in FIG. 2C. The pass of the print head at this printing position results in the available printing locations on scan lines $L_7$ and $L_8$ being partially filled from ink depositions on the odd-numbered printing locations from nozzles 30-2 and 30-1, respectively. Moreover, this pass results in the completion of the scan lines $L_3$ and $L_4$ as a result of the depositions on the even-numbered printing locations from nozzles 30-4 and 30-3, respectively. Once again the nozzles 30-2 and 30-4 have been used cooperatively to complete one scan line (the line $L_5$) and the nozzles 30-1 and 30-3 have cooperated to complete a different scan line (the line $L_6$).

The pattern continues in like manner as the substrate is advanced to printing positions $Y_4$, $Y_5$, and $Y_6$, respectively illustrated in FIGS. 2D, 2E and 2F. The pass occurring at position $Y_6$ (FIG. 2F) containing the image lines $L_{11}$ and $L_{12}$ are only partially filled by nozzles 30-1 and 30-2, respectively.

The image is printed in bands that get completed whenever the print head has passed $P_H$ times over a region of the substrate S. However, owing to the manner in which the drop pattern is deposited the scan lines in the leader band (the first band) and the trailer band (the last band) are not completely filled.

For any one pass, if the number of printing locations filled by each nozzle is tabulated a "drop-density profile" of the print head may be constructed. The "drop-density profile" of the print head relates the probability that an individual printing location will receive a drop of ink from an individual nozzle.

As seen by inspection of any of FIGS. 2A through 2F, on any one line during any one pass each nozzle deposits ink on only five of the ten available printing locations on that line. It is apparent from inspection that on each pass the probability that a print location will receive a drop of ink from a given nozzle is fifty percent (50%). Each drop-density profile for the print head during that pass is shown on the lower portion of each respective Figure.

As seen from FIG. 3 the overall effect is identical to that achieved if the print head is viewed as a "window" sliding across the lines of the image. FIG. 3 shows each drop-density profile of each pass of the print head convolved with the location of the pass on the image. The desired location of each printing position relative to the image is also indicated on the plots of FIG. 3.

The result of convolving the drop-density profile of the print head over all of the passes is the density profile of the image shown on the last graph of FIG. 3. The flatness of the density profile of the image (ignoring the incomplete leader and trailer regions at the beginning and end of the image) indicates a uniformity of print quality of the entire image. FIGS. 2A through 2F and FIG. 3 thus demonstrate that multipass printing is effective to decrease the probability of banding due to nozzle failure.

However, even using the practice of horizontal multipass as insurance against the possibility of nozzle failure it is still possible for banding to occur. Since the substrate transport system is basically a rolling arrangement that uses friction to transport the substrate even with the presence of a vacuum system some slippage occurs between the substrate and the transport. The slippage produces to a quasi-random perturbation in the media transport system. FIG. 4 is a view similar to FIG. 3 that shows the effects of multipass printing in a printer having a quasi-random media transport perturbation.

Assume that the perturbation is such that for each pass the advance of the substrate to its printing location the perturbation has a value "δ". On the first pass the edge of the substrate is located by the transport to a position forward of the desired printing position $Y_1$ by the value "δ". On the second pass the substrate is displaced by the perturbation "δ" from the position occupied by the substrate on the preceding pass. The effect of the perturbation is cumulative. Thus, for the second pass the substrate is located a distance "2·δ" forward of the desired printing position $Y_2$. A similar accumulation of perturbations occurs for each pass, as indicated on the drawing.

The density profile constructed for an image produced by a printer system having a media transport perturbation (lowermost graph in FIG. 4) clearly reveals periodic density deviations D. These density deviations impart discernible streaks in the image. If the perturbation were to result in a delay of the substrate, the density deviations would manifest themselves as periodic regions of lesser density.

To prevent this type of media transport perturbations printers are calibrated to compensate for excess play when a particular set of substrates is used. Substrates used in high-accuracy systems are also designed such that some physical properties, like media curling, are optimized for the internal mechanism of the printer. However, these precautions are rendered ineffective when the substrate changes drastically from one print task to the next.

Accordingly, in view of the foregoing it is believed advantageous to provide a method, a printing apparatus and a program for controlling the printing apparatus that is more robust and able to compensate for transport perturbations and the deleterious banding effects caused thereby without regard to the nature of the substrate being printed.

SUMMARY OF THE INVENTION

The present invention relates in its various aspects to a method, to a printing apparatus and to a program for an ink jet printer that minimizes the deleterious banding effects produced by media transport perturbations introduced as the substrate is advanced along the path of travel to sequential printing positions.

In one aspect the present invention is directed to a multipass printing method comprising the steps of:

a) incrementally advancing a substrate to predetermined printing positions disposed along a path of travel;

b) at each printing position, passing a print head having N nozzles therein along a direction oriented substantially transversely to the path of travel so that on any one pass at least some of the N nozzles in the print head each addresses a plurality of print locations disposed along a respective scan line defined on the substrate;

c) during a pass, actuating a nozzle to deposit printing ink on a predetermined number Q of selected print locations on the given scan line addressed by that nozzle on that pass; and d) repeating steps a) through c) $P_H$ number of times so that on every pass after $P_H$ number of passes each scan line is addressed by a different nozzle;

the method being characterized in that, on any given pass, the number Q of selected print locations onto which printing ink is deposited by each of the N nozzles varies from nozzle to nozzle, and wherein substantially all of the print locations Q on a scan line are filled after $P_H$ number of passes over that scan line.

The nozzle-to-nozzle variation in the number of print locations receiving ink from a given nozzle varies in accordance with a predetermined, non-constant, functional relationship. In a preferred instance the functional relationship defining the nozzle-to-nozzle variation is substantially defined by a weighted smoothing spline function. Most preferably, the weighted smoothing spline function is a polynomial B-spline function of the order "j", where $j=(P_H-1)$ .

The present invention is also embodied in an apparatus that includes a program-controlled printer controller that implements the method described and in the form of a computer readable medium that includes a program of instructions for controlling a computing-controlled printing apparatus to perform the described method.

BRIEF DESCRIPTION OF THE DRAWINGS

The invention will be more fully understood from the following detailed description, taken in connection with the accompanying drawings, which form a part of this application and in which:

FIG. 7A is a plot, similar to FIG. 3, showing the drop-density profile and the image density profile of the entire image for a simplified hypothetical example of the present invention herein discussed, while FIGS. 8A and 8B are drawing representations of color images respectively printed using a multipass technique of the prior art and the multipass method in accordance with the present invention, while

DETAILED DESCRIPTION OF THE INVENTION

Figure 1:
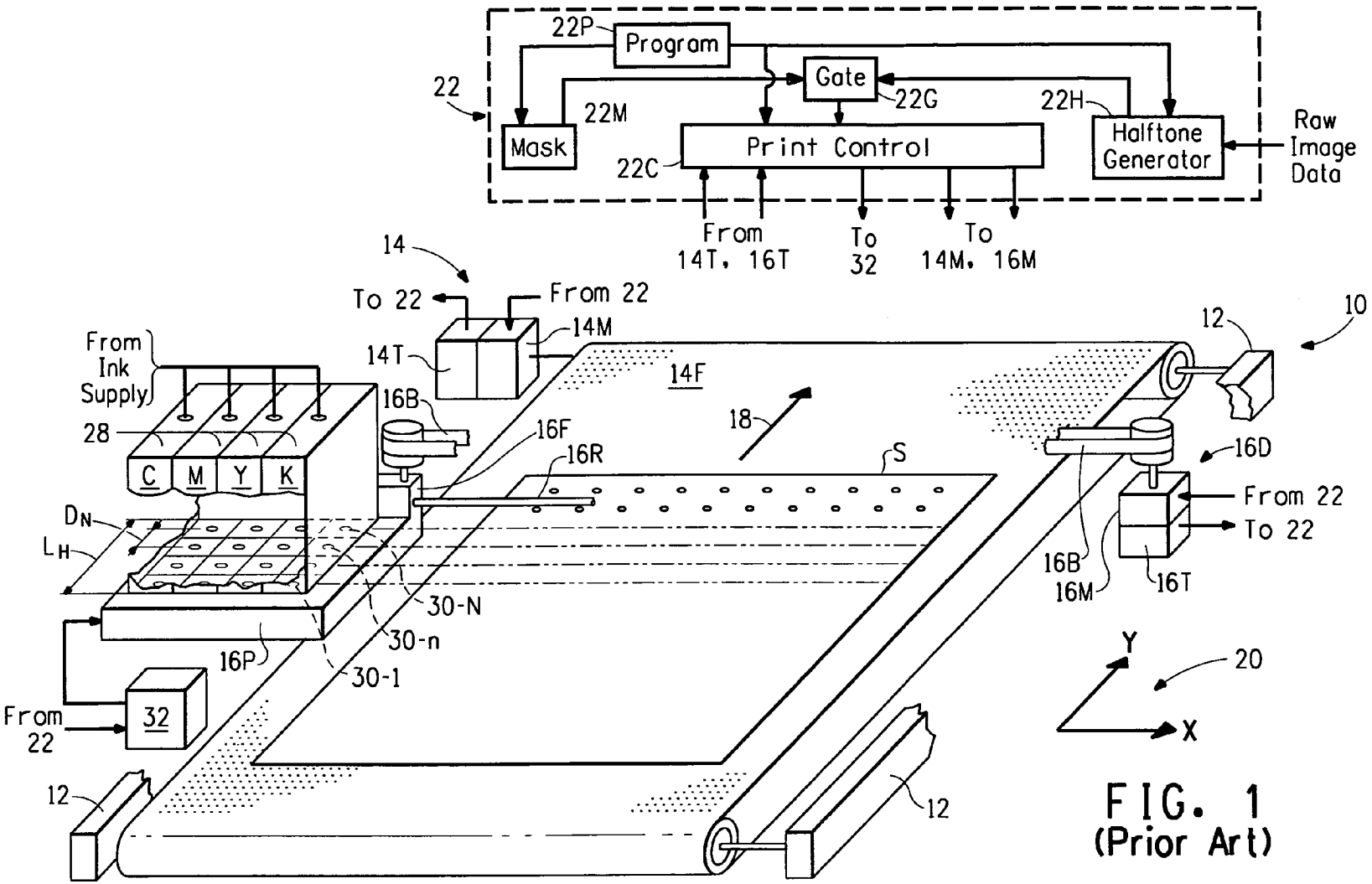
FIG. 1 (Prior Art)
FIG. 1 is a stylized pictorial representation of the mechanical and control elements of a typical large scale ink jet printer of the prior art from which may be gained an understanding of the rudiments of the print operation and the origin of the problem of banding.
Figure 2B:
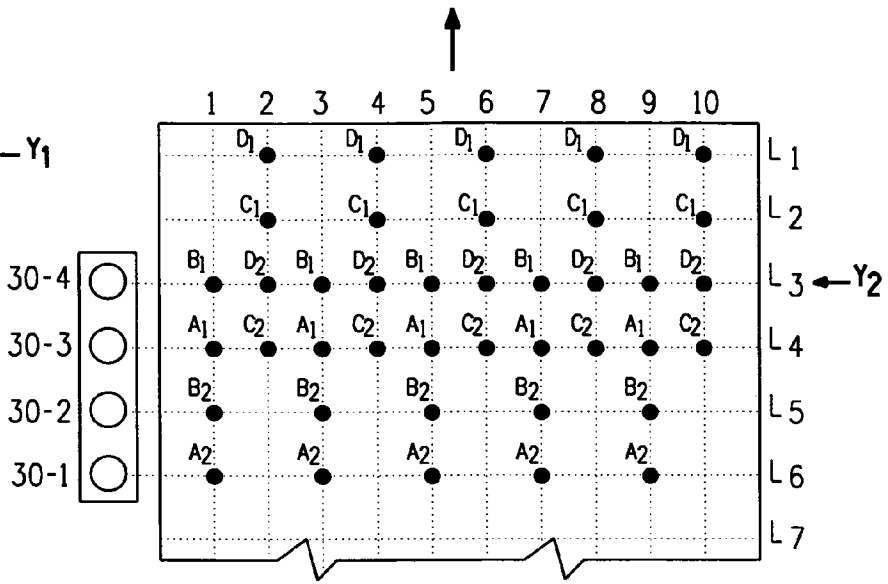
FIG. 2B (Prior Art)
FIGS. 2A through 2F are a series of diagrammatic illustrations showing a simplified hypothetical example in which printed drops are laid onto a substrate using a simple horizontal multipass technique in which each scan line is addressed by two different nozzles (i.e., $P_H=2$)
Figure 2B:
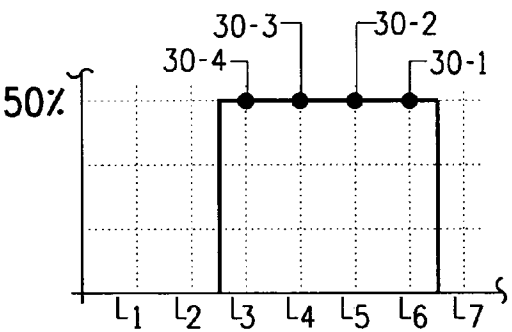
FIG. 2B (Prior Art)
Figure 2A:
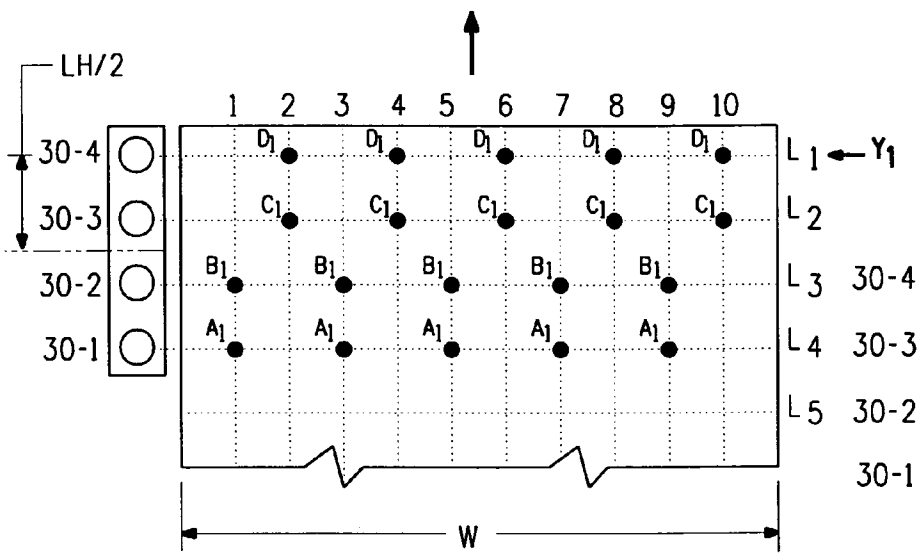
FIG. 2A (Prior Art)
Figure 2A:
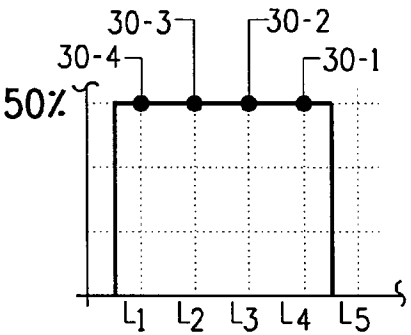
FIG. 2A (Prior Art)
Figure 2D:
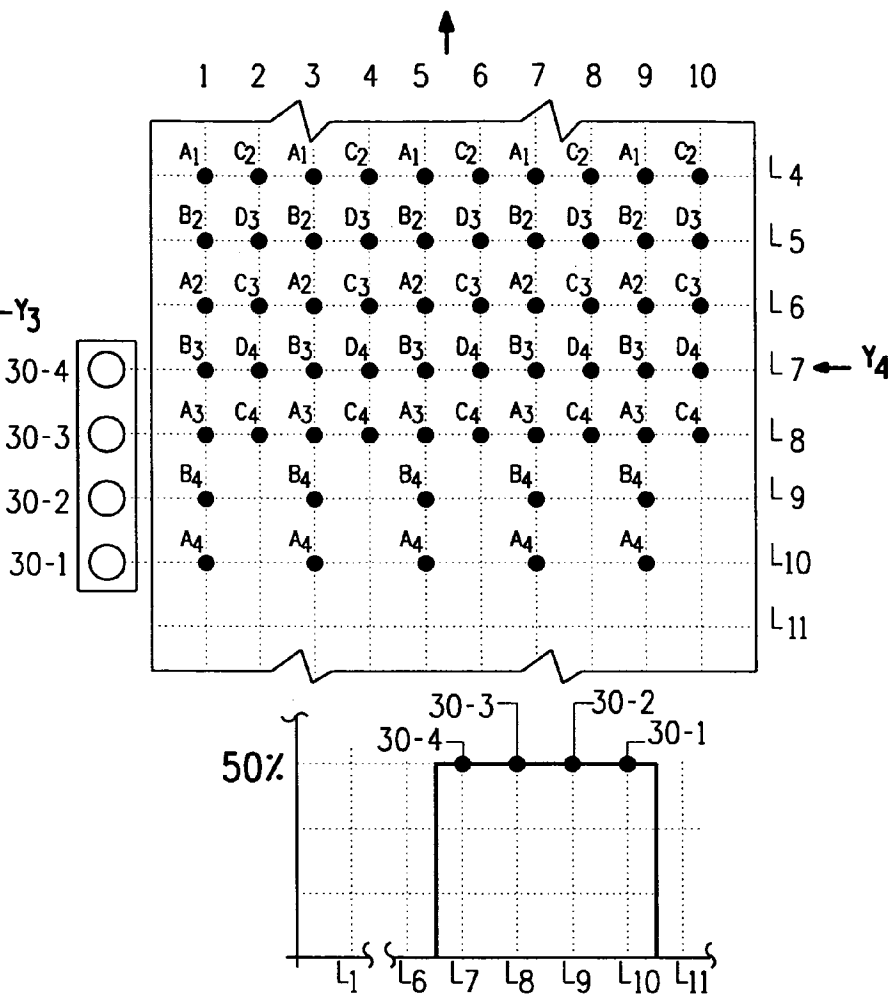
FIG. 2D (Prior Art)
Figure 2C:
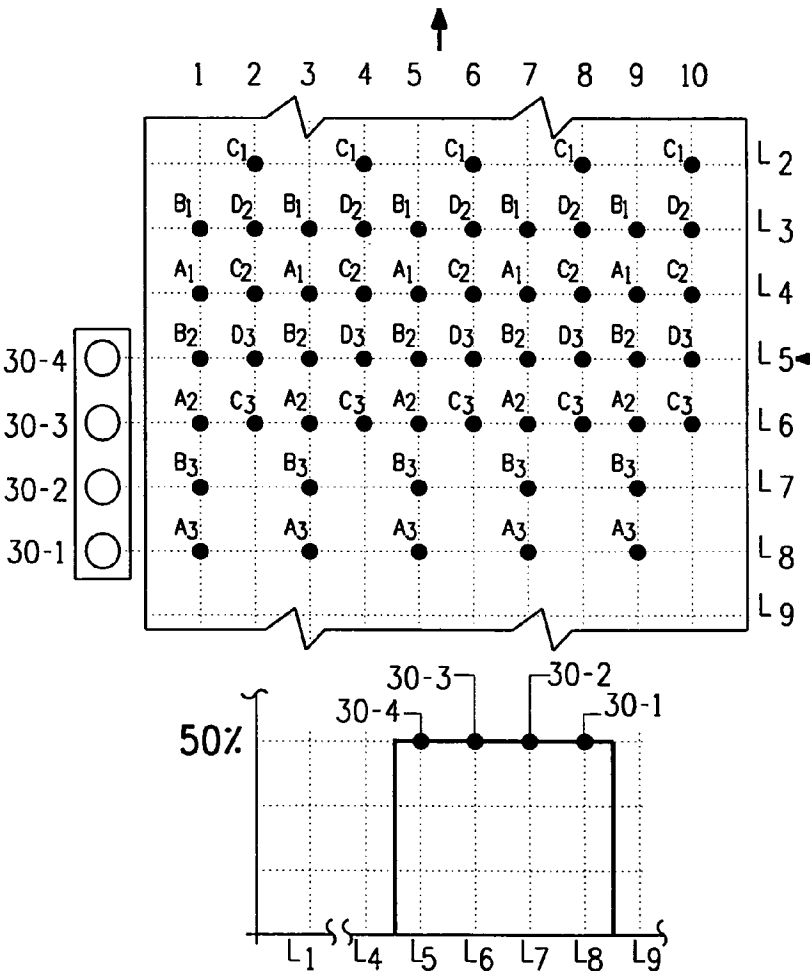
FIG. 2C (Prior Art)
Figure 2F:
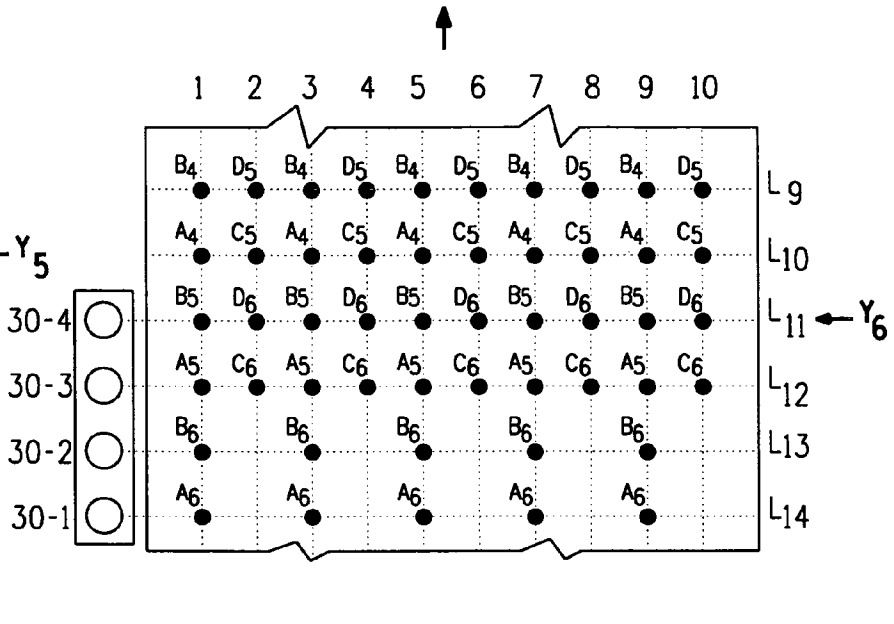
FIG. 2F (Prior Art)
Figure 2F:
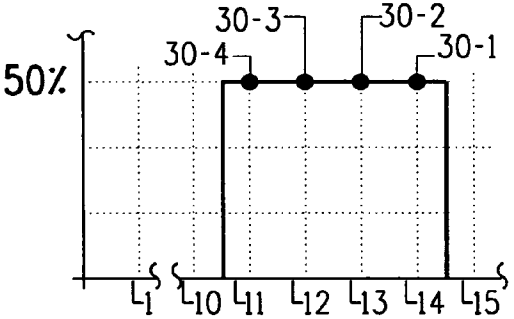
FIG. 2F (Prior Art)
Figure 2E:
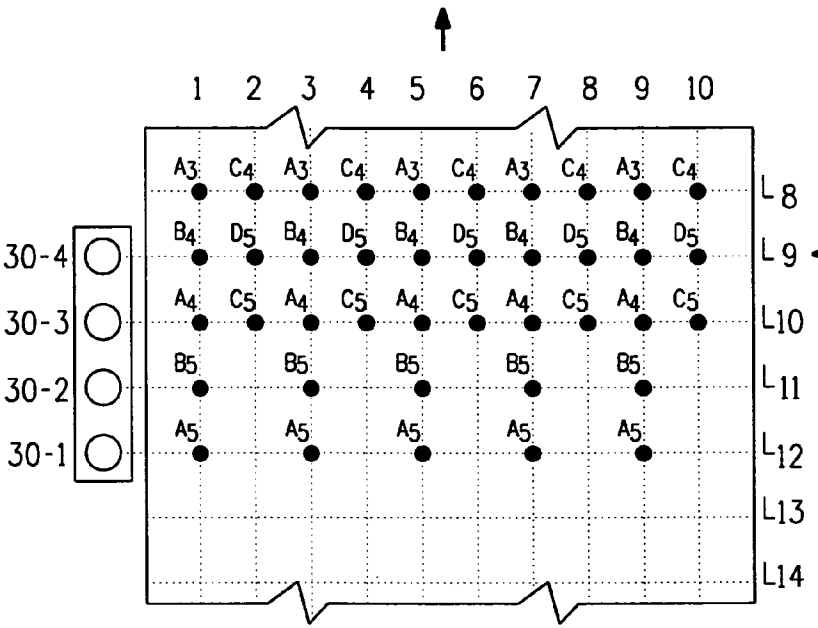
FIG. 2E (Prior Art)
Figure 2E:
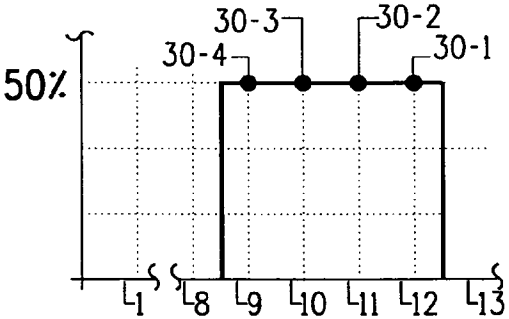
FIG. 2E (Prior Art)

Throughout the following description similar reference numerals refer to similar elements in all Figures of the drawings.

As fully explained in connection with FIGS. 2 and 3 it is apparent that in the typical prior art printing operation using a horizontal multipass technique the drop probability on every pass $P_H$ is a constant value from nozzle to nozzle. To fill the entirety of all of the image bands the drop-density at every pass must be $1/P_H$. For the simplified hypothetical multipass example discussed above with $P_H$ equal to two, one-half (½) of the drops must be printed on the first pass and the other one-half of the drops must be printed in the other pass. However, as shown and discussed it is the constancy of the drop-density probability from nozzle-to-nozzle that is the source of the density deviations seen in FIG. 4 when a transport perturbation occurs.

In accordance with the present invention the number Q of selected print locations onto which printing ink is deposited by the each of the nozzles varies from nozzle-to-nozzle, with the proviso that all of the drops required by the image data are rendered (i.e., 100% of all required print locations are filled) after the number $P_H$ passes have been made. That is to say, on each pass the number Q of selected print locations onto which printing ink is deposited by a nozzle varies from nozzle-to-nozzle in accordance with a predetermined, non-constant, functional relationship.

In a preferred instance the functional relationship defining the nozzle-to-nozzle variation is substantially defined by a weighted smoothing spline function. As will be developed, in accordance with the present invention a particular form of weighted smoothing spline function is most preferred.

By way of that development a printed image E(y) produced by multipass printing as explained earlier (FIGS. 2A through 2F) may be mathematically described by the relationship:

$$E(y) = \sum_{m=0}^{M} \sum_{n=0}^{N-1} Q_n \cdot V_h(y - n \cdot D_N - m \cdot A_V + Y_O + \delta) \tag{4}$$

where $Q_n$ is a discrete set of N numbers, one per nozzle, representing the number of print locations addressed by the n-th nozzle, where $V_h$ is an operator representing the human visual response produced by convolving a square pulse with Gaussian mimicking the low pass filtering response of human sight, and where M is the total number of passes made over the entire image, taken under a probability constraint $$\sum_{n=0}^{\frac{N}{P_H}-1}\sum_{k=0}^{P_H-1} Q_{n+k\cdot\frac{N}{P_H}} = 1 \tag{5}$$

The constraint indicates that all of the print locations $Q_n$ are filled after $P_H$ number of passes over a line.

Minimization of the roughness measure of Equation (4) will yield the optimal set $Q_n$ of print location allocations.

C. deBoor, "Calculation of smoothing spline with weighted roughness measure". Math. Models Methods Appl. Sci.; 11 (1); 2001; pp. 33-41, 2001 provides a classical definition of the roughness of a function, such as the function E(y), as:

$$R = \int_a^b \left(\frac{\partial^j E(y, Qn, \delta)}{\partial y^j}\right)^2 dy \tag{6}$$

Using appropriate assumptions that a large number of closely spaced nozzles N occupy the physical length dimension $L_H$ of the print head, the evaluation of roughness reduces to an equation known in the literature as polynomial B-spline function of the order "j". See, e.g., C.deBoor, "Best approximation properties of splines functions of odd degree", J. Mech. Math.12, pp. 747-749, 1963; G. Mikula, "A variational approach to spline functions theory", Rend. Sem. Mat. Univ. Pol. Torino 61, pp. 209-227, 2003.

I. J. Schoenberg, "Cardinal interpolation and spline functions," Journal of Approximation Theory 2, pp. 167-206, 1969 defines the form of a polynomial B-spline function of the order "j" as follows:

$$Q_j(y) = \sum_{i=0}^{j+1} \frac{(-1)^i}{j!}\binom{j+1}{i}\left(y+\frac{j+1}{2}-i\right)^j \cdot U\left(y+\frac{j+1}{2}-i\right) \tag{7}$$

$$\text{where } U(y) = \begin{vmatrix} 0 : Y < 0 \\ 1 : Y \geq 0 \end{vmatrix} \tag{8}$$

To comply with the constraint of Equation (5) it is required that the order j of the spline is $$j=(P_H-1) \tag{9}$$

Assuming the spline of Equation (7) has a domain that corresponds to the physical length dimension $L_H$ of the print head, sampling the spline at every nozzle position yields the optimal number $Q_n$ of drops printed by the n-th nozzle in a multipass operation having a number $P_H$ horizontal passes as defined by the relation:

$$Q_n = \sum_{i=0}^{P_H} \frac{(-1)^i}{(P_H-1)!}\binom{P_H}{i}\left(\frac{n+\frac{P_H-N}{2}}{\frac{N}{P_H}}-i\right)^{P_H-1} \cdot U\left[\left(\frac{n+\frac{P_H-N}{2}}{\frac{N}{P_H}}-i\right)\right] \tag{10}$$

Although N must be a multiple of $(P_V \times P_H)$ it should be noted that the number of passes $P_V$ implemented for vertical multipass reasons does not enter into the relation of Equation (10).

Figure 5:
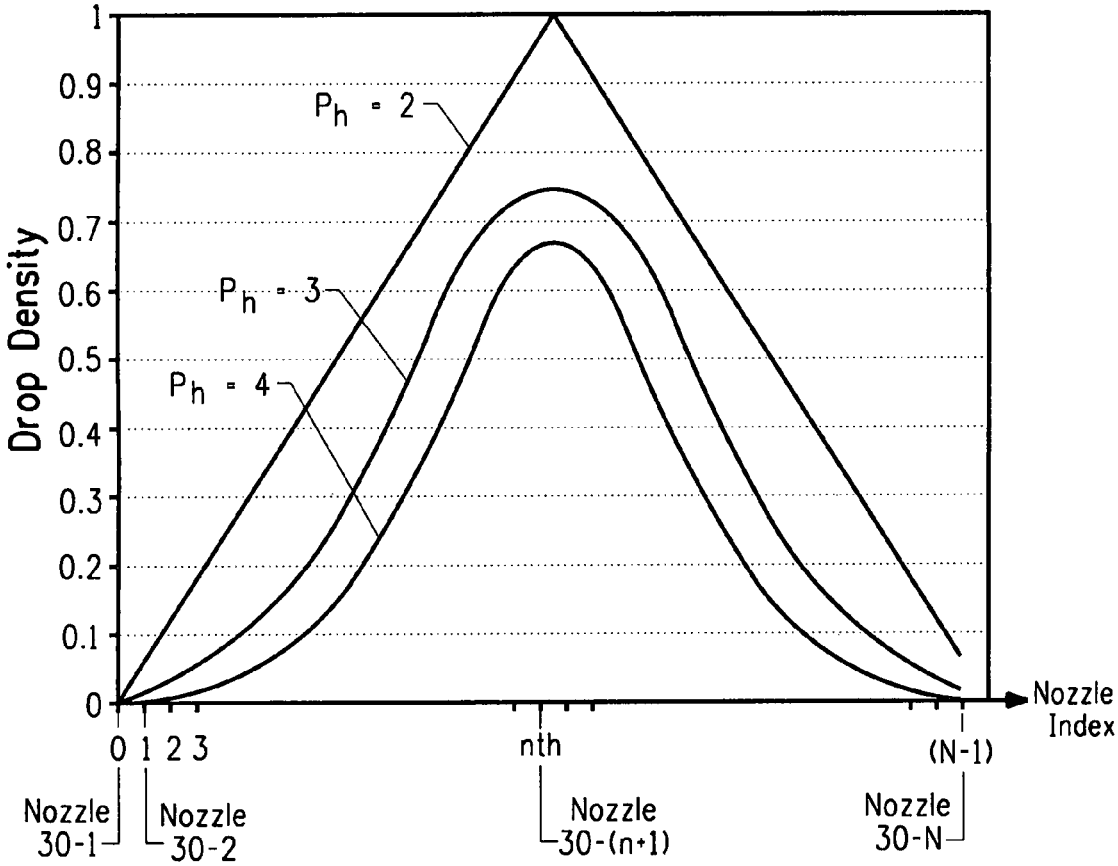
FIG. 5 is a plot of a family of splines of order j=1, 2, and 3 respectively corresponding to a multipass operation having $P_H=2$, 3, and 4 horizontal passes from which the nozzle-to-nozzle variation in the number of print locations may be determined in accordance with the present invention.

FIG. 5 is a plot of a family of splines corresponding to Equation (10) for orders j=1, 2 and 3 corresponding to a multipass operation having 2, 3 and 4 $P_H$ horizontal passes, respectively. The ordinate of the plot is the percentage of the total number of print locations on a scan line. The number N of nozzles on the print head is scaled in equal increments to fit on the abscissa of the plot. The value x=0 corresponds to the first nozzle (e.g., the nozzle 30-1) and the value (N−1) corresponds to the N-th nozzle. The value of the appropriate curve sampled at any nozzle index position is the number of print locations at which ink is dropped by that nozzle. In any given printing situation, for purposes of power efficiency and color consistency, lower order splines (j=3 or less) may be preferred.

Figure 6:
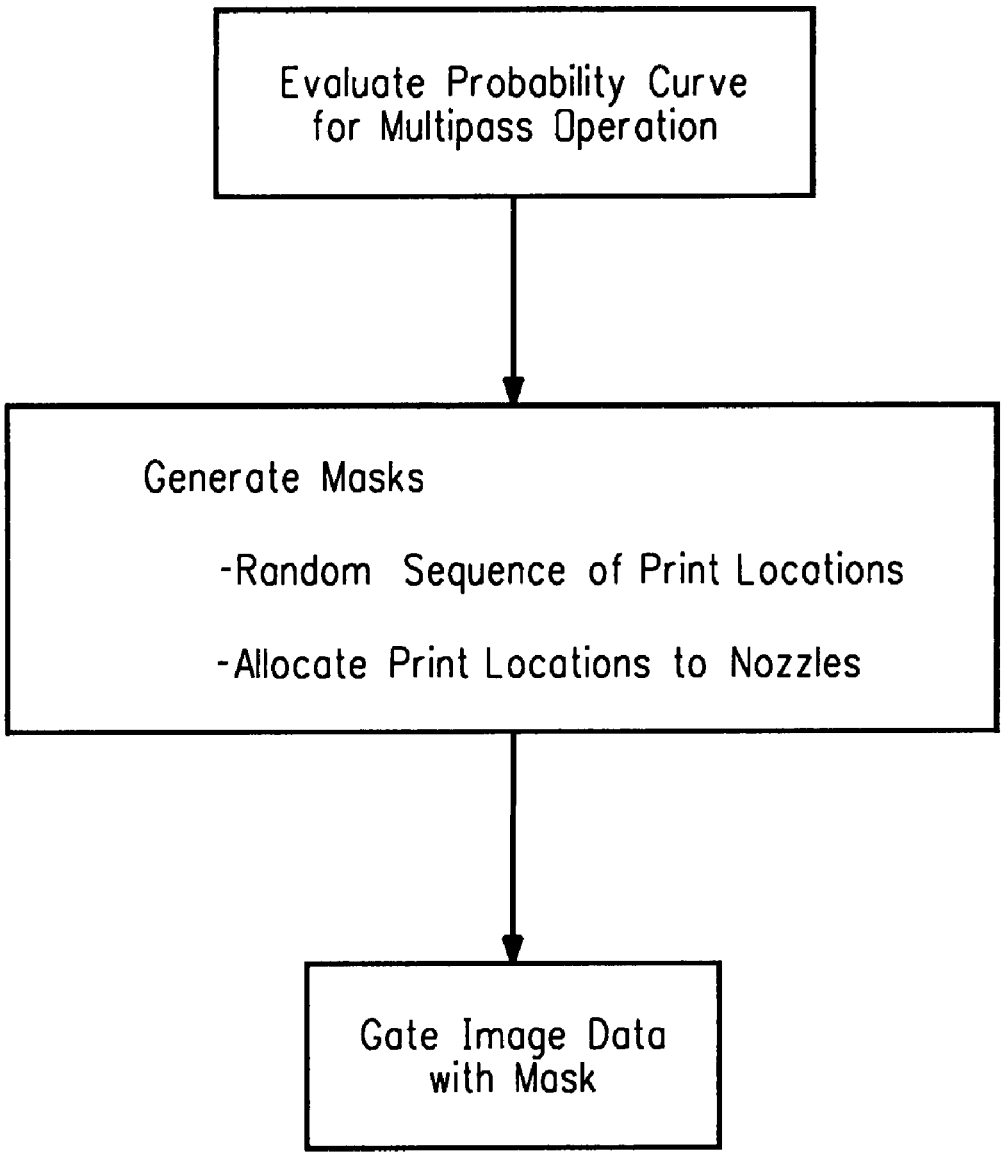
FIG. 6 is a flow diagram of an implementation of the present invention.

The invention may be implemented in a preferred instance by embodying the nozzle-to-nozzle variation in the mask 22M (FIG. 1) that gates the image data. A flow diagram of such an implementation of the present invention is illustrated in FIG. 6.

To implement the present invention Equation (10) is evaluated to determine the nozzle-to-nozzle variation in the number of print locations receiving ink from a given nozzle N (out of the N total nozzles) for a horizontal multipass operation having a given number $P_H$ of horizontal passes. The evaluation of the Equation (10) applies on all of the passes executed in the multipass operation.

The evaluated values and a random sequence of print locations are used to generate masks that gate image data. The sequence is derived by randomly selecting the indices of individual print locations from a uniform distribution of the total number of print locations. The print locations are allocated to each nozzle for a given pass in accordance with the number of print locations assigned by the evaluation of Equation (10) for that nozzle for that pass.

The identity of the print locations allocated to a nozzle is determined by the order of the print locations in the random sequence. The mask so produced for each pass by a nozzle over an image line is gated with the image data for that line.

In some instances, as where the total number of print locations being allocated is large, a mask may be generated for some subset of that total number of print locations on a line and that mask used repeatedly for that line. For example, a ten-inch wide scan line having a 500 dpi resolution contains five thousand locations. In such an instance the size of the probability space from which the random sequence is derived may be truncated to a more manageable number, e.g., 250 print locations. The random sequence is generated from this probability universe and the mask so produced is repeated twenty times across that scan line.

It is believed that the implementation of the invention will be more clearly understood from the following simplified hypothetical example. The same hypothetical image as printed in FIGS. 2A through 2F is again printed using the four nozzle ink jet printer of FIG. 1 but operated instead in accordance with the robust multipass method of the present invention. Table 1 is a digital representation of the image data for a solid image, where the bit "1" indicates the presence of a drop at the corresponding pixel while the bit "0" indicates the absence of a drop:

TABLE 1

| Image Pixel Location → | 1 | 2 | 3 | 4 | 5 | 6 | 7 | 8 | 9 | 10 |
|---|---|---|---|---|---|---|---|---|---|---|
| Line $L_1$ | 0 | 0 | 0 | 0 | 0 | 0 | 0 | 0 | 0 | 0 |
| Line $L_2$ | 0 | 0 | 0 | 0 | 0 | 0 | 0 | 0 | 0 | 0 |
| Line $L_3$ | 1 | 1 | 1 | 1 | 1 | 1 | 1 | 1 | 1 | 1 |
| Line $L_4$ | 1 | 1 | 1 | 1 | 1 | 1 | 1 | 1 | 1 | 1 |
| Line $L_5$ | 1 | 1 | 1 | 1 | 1 | 1 | 1 | 1 | 1 | 1 |
| Line $L_6$ | 1 | 1 | 1 | 1 | 1 | 1 | 1 | 1 | 1 | 1 |
| Line $L_7$ | 1 | 1 | 1 | 1 | 1 | 1 | 1 | 1 | 1 | 1 |
| Line $L_8$ | 1 | 1 | 1 | 1 | 1 | 1 | 1 | 1 | 1 | 1 |
| Line $L_9$ | 1 | 1 | 1 | 1 | 1 | 1 | 1 | 1 | 1 | 1 |
| Line $L_{10}$ | 1 | 1 | 1 | 1 | 1 | 1 | 1 | 1 | 1 | 1 |
| Line $L_{11}$ | 1 | 1 | 1 | 1 | 1 | 1 | 1 | 1 | 1 | 1 |
| Line $L_{12}$ | 1 | 1 | 1 | 1 | 1 | 1 | 1 | 1 | 1 | 1 |
| Line $L_{13}$ | 0 | 0 | 0 | 0 | 0 | 0 | 0 | 0 | 0 | 0 |
| Line $L_{14}$ | 0 | 0 | 0 | 0 | 0 | 0 | 0 | 0 | 0 | 0 |

Since an X-interlace of two ($P_H$=2) is used to print the image the nozzles of the print head are divided into two groups, with nozzles 30-1 and 30-2 comprising one group and nozzles 30-3 and 30-4 comprising the other group.

Analogous to the manner in which the lines are formed in the Example discussed in connection with FIGS. 2A through 2F, the line assignments for each line of the image on each pass across the substrate, (where lines 1 and 2 define an image leader that is addressed on only the first pass of the print head and where lines 13 and 14 define an image trailer addressed on only the sixth pass of the print head) are as follows:

TABLE 2

| Line Number | Nozzle on Pass 1 | Nozzle on Pass 2 |
|---|---|---|
| Line $L_1$ | 30-4 | — |
| Line $L_2$ | 30-3 | — |
| Line $L_3$ | 30-2 | 30-4 |
| Line $L_4$ | 30-1 | 30-3 |

TABLE 2-continued

| Line Number | Nozzle on Pass 1 | Nozzle on Pass 2 |
|---|---|---|
| Line $L_5$ | 30-2 | 30-4 |
| Line $L_6$ | 30-1 | 30-3 |
| Line $L_7$ | 30-2 | 30-4 |
| Line $L_8$ | 30-1 | 30-3 |
| Line $L_9$ | 30-2 | 30-4 |
| Line $L_{10}$ | 30-1 | 30-3 |
| Line $L_{11}$ | 30-2 | 30-4 |
| Line $L_{12}$ | 30-1 | 30-3 |
| Line $L_{13}$ | 30-2 | — |
| Line $L_{14}$ | 30-1 | — |

Evaluation of Equation (10) using a four nozzle (N=4) print head (nozzles 30-1, 30-2, 30-3 and 30-4) for two horizontal passes per scan line ($P_H$=2) results in the following nozzle-to-nozzle variation in the number of print locations:

TABLE 3

| Nozzle Group | Nozzle | Percentage of Print Locations |
|---|---|---|
| 1 | 30-1 | 0% |
| 1 | 30-2 | 50% |
| 2 | 30-3 | 100% |
| 2 | 30-4 | 50% |

The identity of the locations allocated to a given nozzle is determined in accordance with a random sequence of print locations. For purposes of this simplified discussion a possible random sequence of the print locations with a uniform distribution is:

4-6-9-7-2-8-3-10-1-5.

Taking the masks for each pass for each line in the image together with the allocation of the number of print locations addressed by a nozzle yields the identity of the print locations addressed by that nozzle. For the simplified example being developed, the identities are as follows [where the binary digit "1" indicates that a nozzle will deposit a drop on that print location and with the digit "0" (no drop) being omitted from Tables 3 and 4 for clarity]:

TABLE 4A

| | | | Mask For Line 1 | | | | | | | | | |
|---|---|---|---|---|---|---|---|---|---|---|---|---|
| Location → | Nozzle | % | 1 | 2 | 3 | 4 | 5 | 6 | 7 | 8 | 9 | 10 |
| Line 1 First Pass (Pass 1) | 30-4 | 50 | | 1 | | 1 | | 1 | 1 | | 1 | |
| Line 1 Second Pass (Pass 2) | — | — | — | — | — | — | — | — | — | — | — | — |

TABLE 4B

| | | | Mask For Line 2 | | | | | | | | | |
|---|---|---|---|---|---|---|---|---|---|---|---|---|
| Location → | Nozzle | % | 1 | 2 | 3 | 4 | 5 | 6 | 7 | 8 | 9 | 10 |
| Line 2 First Pass (Pass 1) | 30-3 | 100 | 1 | 1 | 1 | 1 | 1 | 1 | 1 | 1 | 1 | 1 |
| Line 2 Second Pass (Pass 2) | — | — | — | — | — | — | — | — | — | — | — | — |

TABLE 4C

| | | | Mask For Line 3 | | | | | | | | | |
|---|---|---|---|---|---|---|---|---|---|---|---|---|
| Location → | Nozzle | % | 1 | 2 | 3 | 4 | 5 | 6 | 7 | 8 | 9 | 10 |
| Line 3 First Pass (Pass 1) | 30-2 | 50 | | 1 | | 1 | | 1 | 1 | | 1 | |
| Line 3 Second Pass (Pass 2) | 30-4 | 50 | 1 | | 1 | | 1 | | | 1 | | 1 |

TABLE 4D

| | | | Mask For Line 4 | | | | | | | | | |
|---|---|---|---|---|---|---|---|---|---|---|---|---|
| Location → | Nozzle | % | 1 | 2 | 3 | 4 | 5 | 6 | 7 | 8 | 9 | 10 |
| Line 4 First Pass (Pass 1) | 30-1 | 0 | | | | | | | | | | |
| Line 4 Second Pass (Pass 2) | 30-3 | 100 | 1 | 1 | 1 | 1 | 1 | 1 | 1 | 1 | 1 | 1 |

Thus, for line 3 for example, the first fifty percent (i.e., the first five) of the print locations on that line are assigned to the first nozzle in the first nozzle group (i.e., nozzle 30-2) addressing that line. The identity of the particular print locations assigned to the nozzle 30-2 is determined by the order that the print locations appear in the random sequence. The balance of the print locations on line 3 is assigned to the corresponding nozzle in the other nozzle group (i.e., nozzle 30-4) that addresses that line with the identities of these print locations being determined by the print locations remaining in the random sequence. In situations involving a greater number of passes and higher order splines the apportionment of print locations among nozzles in the various nozzle groups that address the same scan line is done in a similar fashion.

Since the masks for lines 5, 7, 9, 11 and 13 are identical to the mask for line 3 and since the masks for lines 6, 8, 10, 12 and 14 are identical to that for line 4, the tabularized form of these masks is not repeated. The nozzles addressing the scan lines 5 through 14 on the respective first and second passes are shown in FIGS. 2B through 2F.

With print locations allocated and identified as described, to render the printed image the image data for each line is gated with the mask for that line through the gate 22G, FIG. 1. Omitting any discussion of the image leader (lines 1 and 2) and the image trailer (lines 13 and 14) the rendition for lines 3 through 12 of the sample image for each pass is as follows:

TABLE 5A

| | | Image Rendition: Line 3 | | | | | | | | | |
|---|---|---|---|---|---|---|---|---|---|---|---|
| Print Location → | Nozzle | 1 | 2 | 3 | 4 | 5 | 6 | 7 | 8 | 9 | 10 |
| Image Data | | 1 | 1 | 1 | 1 | 1 | 1 | 1 | 1 | 1 | 1 |
| Mask Pass 1 | | | 1 | | 1 | | 1 | 1 | | 1 | |
| Drop Location Pass 1 | 30-2 | | 1 | | 1 | | 1 | 1 | | 1 | |
| Mask Pass 2 | | 1 | | 1 | | 1 | | | 1 | | 1 |
| Drop Location Pass 2 | 30-4 | 1 | | 1 | | 1 | | | 1 | | 1 |
| Line Total | | 1 | 1 | 1 | 1 | 1 | 1 | 1 | 1 | 1 | 1 |

The drops required by the image data at print locations 4, 6, 9, 7 and 2 (of the random sequence) are gated and deposited by nozzle 30-2 on pass 1, while the drops required by the image data at print locations 8, 3, 10, 1 and 5 (of the random sequence) are gated and deposited by nozzle 30-4 on pass 2.

TABLE 5B

| | | Image Rendition: Line 4 | | | | | | | | | |
|---|---|---|---|---|---|---|---|---|---|---|---|
| Print Location → | Nozzle | 1 | 2 | 3 | 4 | 5 | 6 | 7 | 8 | 9 | 10 |
| Image Data | | 1 | 1 | 1 | 1 | 1 | 1 | 1 | 1 | 1 | 1 |
| Mask Pass 1 | | | | | | | | | | | |
| Drop Location Pass 1 | 30-1 | | | | | | | | | | |
| Mask Pass 2 | | 1 | 1 | 1 | 1 | 1 | 1 | 1 | 1 | 1 | 1 |
| Drop Location Pass 2 | 30-3 | 1 | 1 | 1 | 1 | 1 | 1 | 1 | 1 | 1 | 1 |
| Line Total | | 1 | 1 | 1 | 1 | 1 | 1 | 1 | 1 | 1 | 1 |

All drops required by the image data at all print locations are gated and deposited by nozzle 30-3 on pass 2.

TABLE 5C

| | | Image Rendition: Line 5 | | | | | | | | | |
|---|---|---|---|---|---|---|---|---|---|---|---|
| Print Location → | Nozzle | 1 | 2 | 3 | 4 | 5 | 6 | 7 | 8 | 9 | 10 |
| Image Data | | 1 | 1 | 1 | 1 | 1 | 1 | 1 | 1 | 1 | 1 |
| Mask Pass 1 | | | 1 | | 1 | | 1 | 1 | | 1 | |
| Drop Location Pass 2 | 30-2 | | 1 | | 1 | | 1 | 1 | | 1 | |
| Mask Pass 2 | | 1 | | 1 | | 1 | | | 1 | | 1 |
| Drop Location Pass 3 | 30-4 | 1 | | 1 | | 1 | | | 1 | | 1 |
| Line Total | | 1 | 1 | 1 | 1 | 1 | 1 | 1 | 1 | 1 | 1 |

The drops required by the image data at print locations 4, 6, 9, 7 and 2 are gated and deposited by nozzle 30-2 on pass 2, while the drops required by the image data at print locations 8, 3, 10, 1 and 5 are gated and deposited by nozzle 30-4 on pass 3.

TABLE 5D

| Image Rendition: Line 6 | | | | | | | | | | | |
|---|---|---|---|---|---|---|---|---|---|---|---|
| Print Location → | Nozzle | 1 | 2 | 3 | 4 | 5 | 6 | 7 | 8 | 9 | 10 |
| Image Data | | 1 | 1 | 1 | 1 | 1 | 1 | 1 | 1 | 1 | 1 |
| Mask Pass 1 | | | | | | | | | | | |
| Drop Location | 30-1 | | | | | | | | | | |
| Pass 2 | | | | | | | | | | | |
| Mask Pass 2 | | 1 | 1 | 1 | 1 | 1 | 1 | 1 | 1 | 1 | 1 |
| Drop Location | 30-3 | 1 | 1 | 1 | 1 | 1 | 1 | 1 | 1 | 1 | 1 |
| Pass 3 | | | | | | | | | | | |
| Line Total | | 1 | 1 | 1 | 1 | 1 | 1 | 1 | 1 | 1 | 1 |

All drops required by the image data at all print locations are gated and deposited by nozzle 30-3 on pass 3.

TABLE 5E

| Image Rendition: Line 7 | | | | | | | | | | | |
|---|---|---|---|---|---|---|---|---|---|---|---|
| Print Location → | Nozzle | 1 | 2 | 3 | 4 | 5 | 6 | 7 | 8 | 9 | 10 |
| Image Data | | 1 | 1 | 1 | 1 | 1 | 1 | 1 | 1 | 1 | 1 |
| Mask Pass 1 | | | 1 | | 1 | | 1 | 1 | | 1 | |
| Drop Location | 30-2 | | 1 | | 1 | | 1 | 1 | | 1 | |
| Pass 3 | | | | | | | | | | | |
| Mask Pass 2 | | 1 | | 1 | | 1 | | | 1 | | 1 |
| Drop Location | 30-4 | 1 | | 1 | | 1 | | | 1 | | 1 |
| Pass 4 | | | | | | | | | | | |
| Line Total | | 1 | 1 | 1 | 1 | 1 | 1 | 1 | 1 | 1 | 1 |

The drops required by the image data at print locations 4, 6, 9, 7 and 2 are gated and deposited by nozzle 30-2 on pass 3, while the drops required by the image data at print locations 8, 3, 10, 1 and 5 are gated and deposited by nozzle 30-4 on pass 4.

TABLE 5F

| Image Rendition: Line 8 | | | | | | | | | | | |
|---|---|---|---|---|---|---|---|---|---|---|---|
| Print Location → | Nozzle | 1 | 2 | 3 | 4 | 5 | 6 | 7 | 8 | 9 | 10 |
| Image Data | | 1 | 1 | 1 | 1 | 1 | 1 | 1 | 1 | 1 | 1 |
| Mask Pass 1 | | | | | | | | | | | |
| Drop Location | 30-1 | | | | | | | | | | |
| Pass 3 | | | | | | | | | | | |
| Mask Pass 2 | | 1 | 1 | 1 | 1 | 1 | 1 | 1 | 1 | 1 | 1 |
| Drop Location | 30-3 | 1 | 1 | 1 | 1 | 1 | 1 | 1 | 1 | 1 | 1 |
| Pass 4 | | | | | | | | | | | |
| Line Total | | 1 | 1 | 1 | 1 | 1 | 1 | 1 | 1 | 1 | 1 |

All drops required by the image data at all print locations are gated and deposited by nozzle 30-3 on pass 4.

TABLE 5G

| Image Rendition: Line 9 | | | | | | | | | | | |
|---|---|---|---|---|---|---|---|---|---|---|---|
| Print Location → | Nozzle | 1 | 2 | 3 | 4 | 5 | 6 | 7 | 8 | 9 | 10 |
| Image Data | | 1 | 1 | 1 | 1 | 1 | 1 | 1 | 1 | 1 | 1 |
| Mask Pass 1 | | | 1 | | 1 | | 1 | 1 | | 1 | |
| Drop Location | 30-2 | | 1 | | 1 | | 1 | 1 | | 1 | |
| Pass 4 | | | | | | | | | | | |
| Mask Pass 2 | | 1 | | 1 | | 1 | | | 1 | | 1 |
| Drop Location | 30-4 | 1 | | 1 | | 1 | | | 1 | | 1 |
| Pass 5 | | | | | | | | | | | |
| Line Total | | 1 | 1 | 1 | 1 | 1 | 1 | 1 | 1 | 1 | 1 |

The drops required by the image data at print locations 4, 6, 9, 7 and 2 are gated and deposited by nozzle 30-2 on pass 4, while the drops required by the image data at print locations 8, 3, 10, 1 and 5 are gated and deposited by nozzle 30-4 on pass 5.

TABLE 5H

| Image Rendition: Line 10 | | | | | | | | | | | |
|---|---|---|---|---|---|---|---|---|---|---|---|
| Print Location → | Nozzle | 1 | 2 | 3 | 4 | 5 | 6 | 7 | 8 | 9 | 10 |
| Image Data | | 1 | 1 | 1 | 1 | 1 | 1 | 1 | 1 | 1 | 1 |
| Mask Pass 1 | | | | | | | | | | | |
| Drop Location | 30-1 | | | | | | | | | | |
| Pass 4 | | | | | | | | | | | |
| Mask Pass 2 | | 1 | 1 | 1 | 1 | 1 | 1 | 1 | 1 | 1 | 1 |
| Drop Location | 30-3 | 1 | 1 | 1 | 1 | 1 | 1 | 1 | 1 | 1 | 1 |
| Pass 5 | | | | | | | | | | | |
| Line Total | | 1 | 1 | 1 | 1 | 1 | 1 | 1 | 1 | 1 | 1 |

All drops required by the image data at all print locations are gated and deposited by nozzle 30-3 on pass 5.

Table 5I: Image Rendition: Line 11

The drops required by the image data at print locations 4, 6, 9, 7 and 2 are gated and deposited by nozzle 30-2 on pass 5, while the drops required by the image data at print locations 8, 3, 10, 1 and 5 are gated and deposited by nozzle 30-4 on pass 6.

Table 5J: Image Rendition: Line 12

All drops required by the image data at all print locations are gated and deposited by nozzle 30-3 on pass 6.

It should be noted that on each scan line the total number of drops gated and deposited by a nozzle addressing the print locations on that line (as mandated by the mask for that line and pass) is exactly that number of drops as mandated by the image data.

Table 6 is a tabular representation of the final printed image, where, as before, drops from the nozzles 30-1 through 30-4 are indicated by the letters "A", "B", "C" and "D", respectively, and the pass on which the drop is produced is indicated by the numeric suffix:

TABLE 6

| Print Location → | 1 | 2 | 3 | 4 | 5 | 6 | 7 | 8 | 9 | 10 |
|---|---|---|---|---|---|---|---|---|---|---|
| L3 | D2 | B1 | D2 | B1 | D2 | B1 | B1 | D2 | B1 | D2 |
| L4 | C2 | C2 | C2 | C2 | C2 | C2 | C2 | C2 | C2 | C2 |
| L5 | D3 | B2 | D3 | B2 | D3 | B2 | B2 | D3 | B2 | D3 |
| L6 | C3 | C3 | C3 | C3 | C3 | C3 | C3 | C3 | C3 | C3 |
| L7 | D4 | B3 | D4 | B3 | D4 | B3 | B3 | D4 | B3 | D4 |
| L8 | C4 | C4 | C4 | C4 | C4 | C4 | C4 | C4 | C4 | C4 |
| L9 | D5 | B4 | D5 | B4 | D5 | B4 | B4 | C5 | B4 | D5 |
| L10 | C5 | C5 | C5 | C5 | C5 | C5 | C5 | C5 | C5 | C5 |
| L11 | D6 | B5 | D6 | B5 | D6 | B5 | B5 | D6 | B5 | D6 |
| L12 | C6 | C6 | C6 | C6 | C6 | C6 | C6 | C6 | C6 | C6 |

Figure 3:
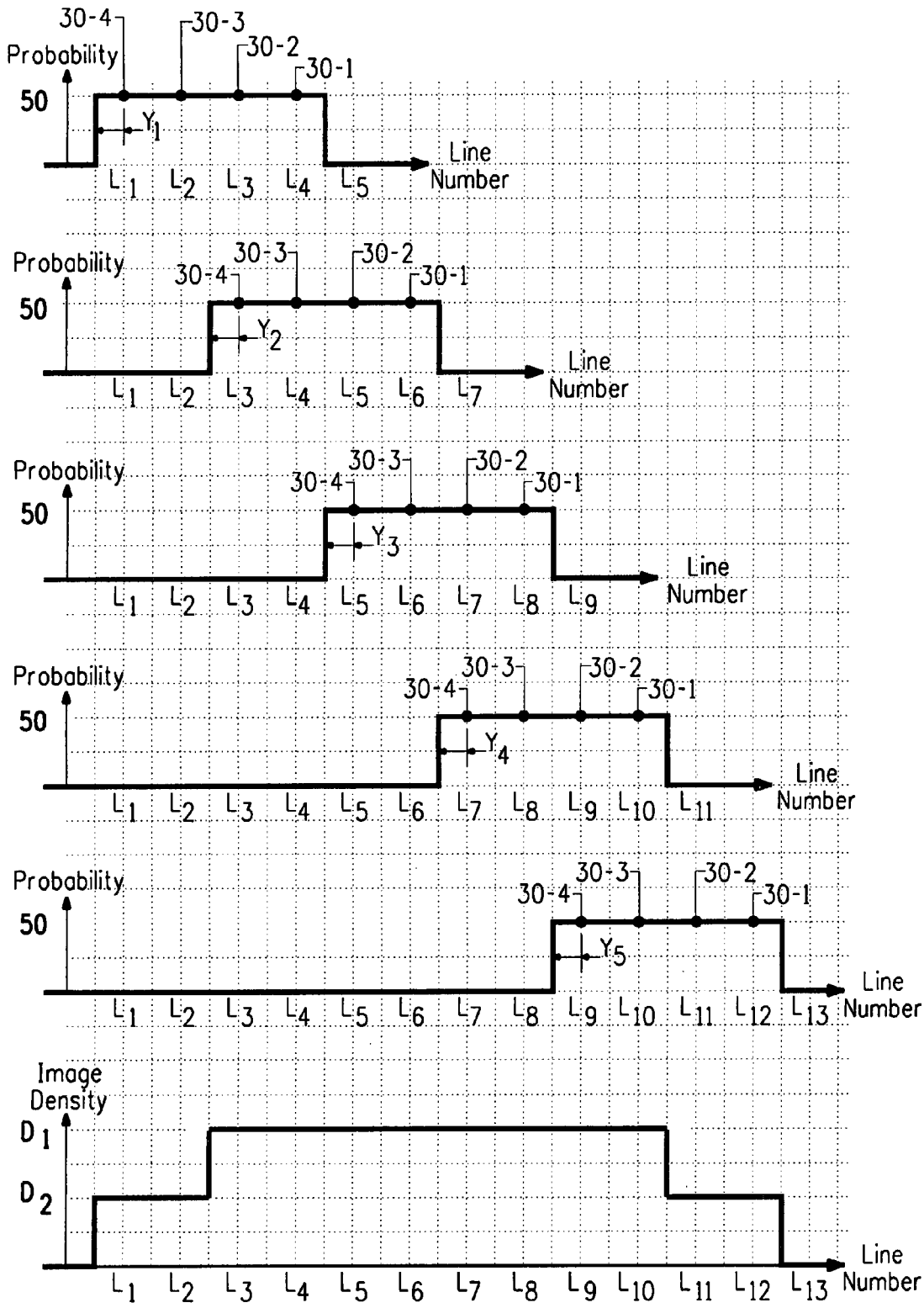
FIG. 3 (Prior Art)
FIG. 3 is a plot showing the drop-density profile of the print head of each pass illustrated in FIG. 2A though 2E and the density profile of the entire image
Figure 4:
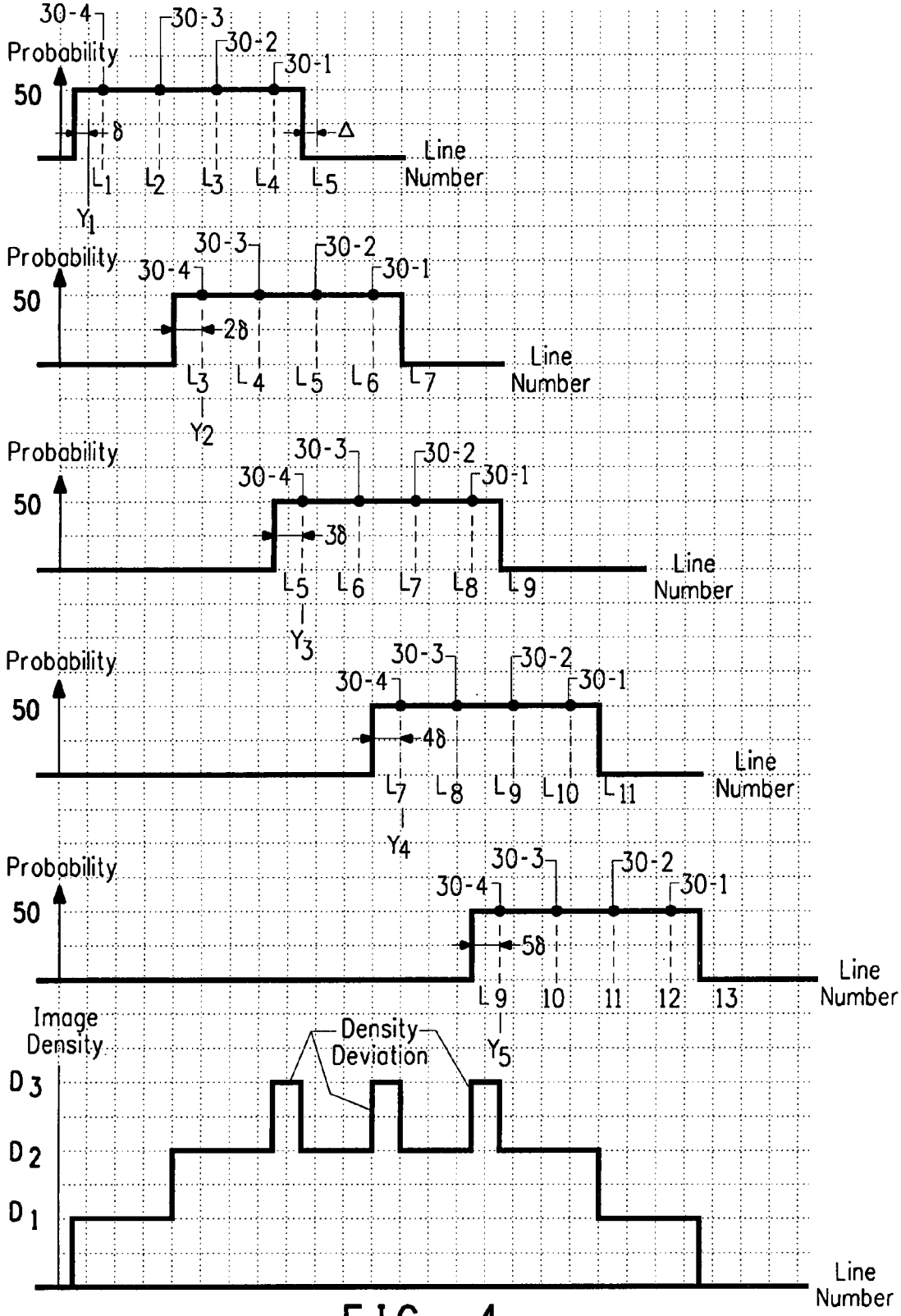
FIG. 4 (Prior Art)
FIG. 4 is a view similar to FIG. 3 showing plots of the drop-density profile of the print head of each pass illustrated in FIG. 2A though 2E and the density profile of the entire image in the presence of a perturbation in media transport.
Figure 7A:
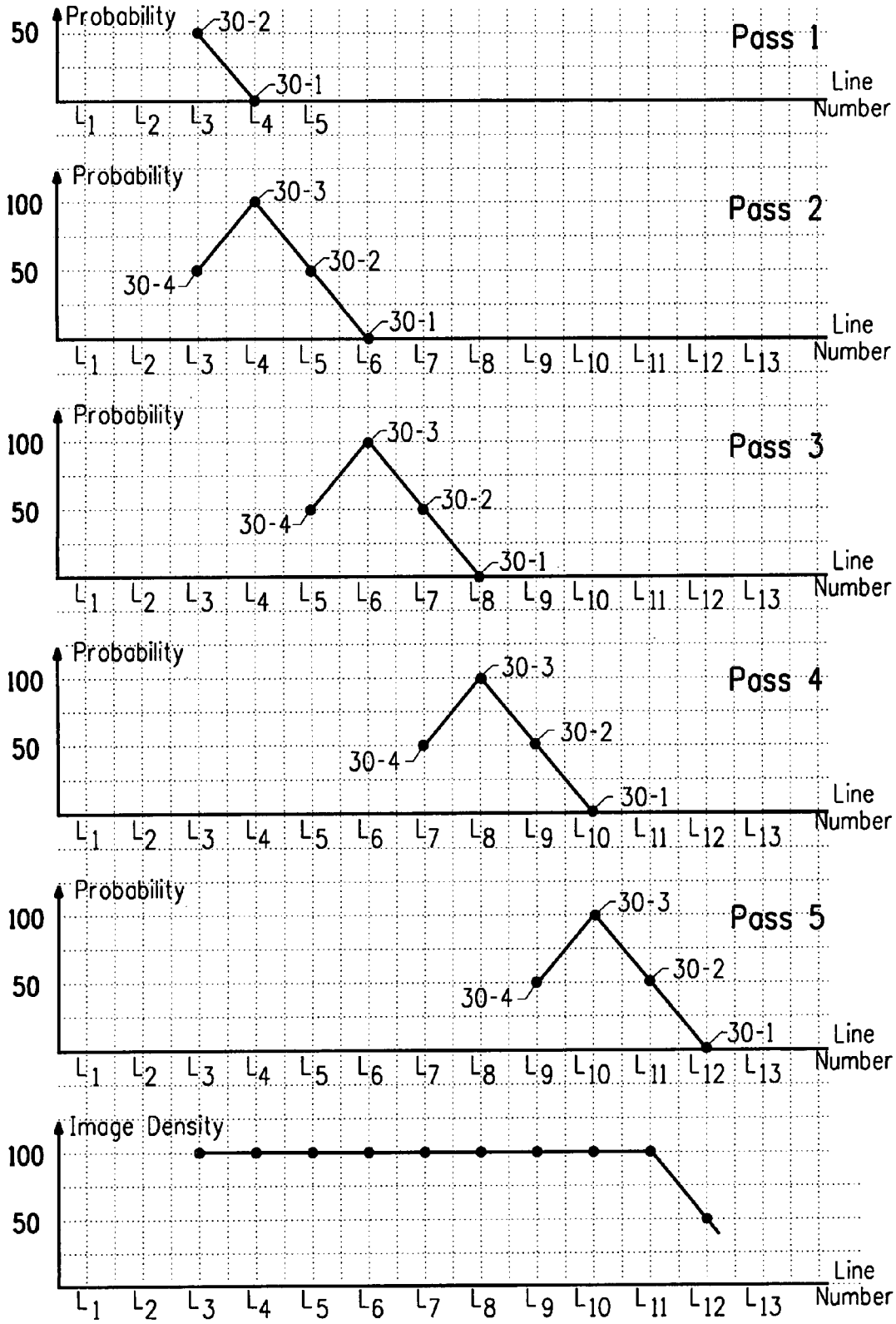

FIG. 7A is a plot, similar to FIG. 3, showing the drop-density profile and the image density profile of the entire image for the simplified hypothetical example of the present invention. The drop-density profile indicates the nozzle-to-nozzle variation in print locations corresponding to the selected spline. The last plot in FIG. 7A shows that use of the present invention still results in a smooth image density profile.

Figure 7B:
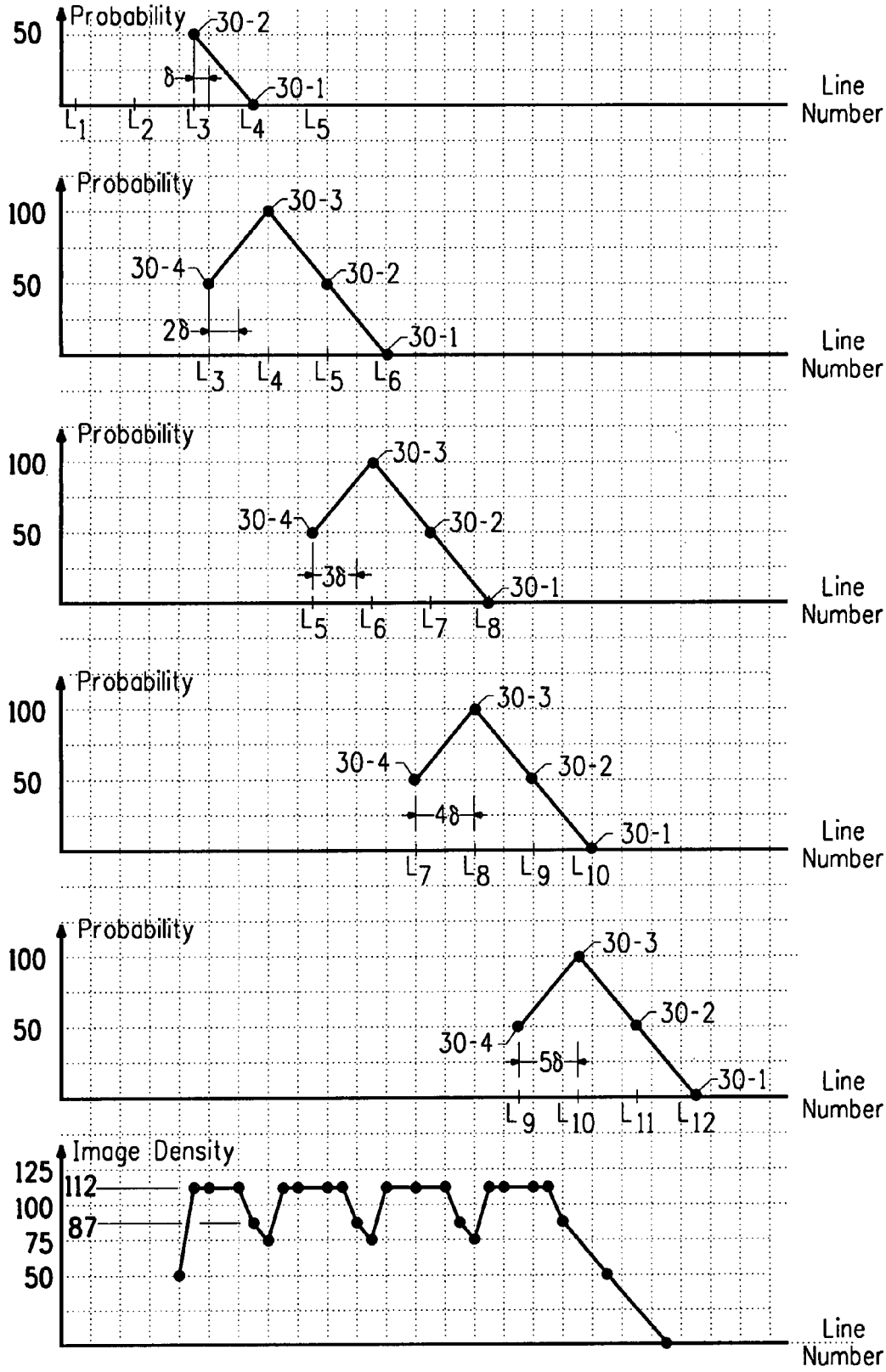
FIG. 7B is a view similar to FIG. 4 showing the drop-density profile and the resulting density profile of the entire image produced using the present invention in the presence of a perturbation in media transport.

Of perhaps more interest is FIG. 7B, which shows the drop-density profile and the resulting density profile of the entire image produced using the present invention in the presence of a perturbation in media transport. As is apparent from the last plot in this FIG. 7B as compared to FIG. 4, even using a minimum number of passes ($P_H$=2, and the corresponding lowest order spline, j=1) the relatively coarse print head (i.e., N=4) provides a smoother image density in the face of transport perturbations than does the prior art. Both the relative magnitude of the density deviations and the slope of the transition into and out of those deviations are smoother than the prior art.

Several clarifying comments are in order. For clarity of understanding this simplified hypothetical example of the present invention uses the most basic order spline (j=1), print head with a low number of print nozzles (N=4), and a minimum number of passes ($P_H$=2). This combination results in one of the nozzles (the nozzle 30-1) not being used to deposit drops on the image. In effect, in this example the insurance against clogging afforded by horizontal multipass is lost in exchange for the smoothing effect in image density deriving from the nozzle-to-nozzle variation. However, for a more typical real-world application that utilizes a higher order spline, a significantly larger print head ($L_H$>>$D_N$) with a correspondingly greater number of nozzles an, the greater number of passes serves to retain the protection against a clogged nozzle. This is true even though the nozzle 30-1 at the extreme end of the print head does not deposit ink on a scan line. Moreover, a higher order spline (corresponding to an increased number of passes) provides a smoother image density and less abrupt changes nozzle-to-nozzle changes in image density.

Figure 8A:
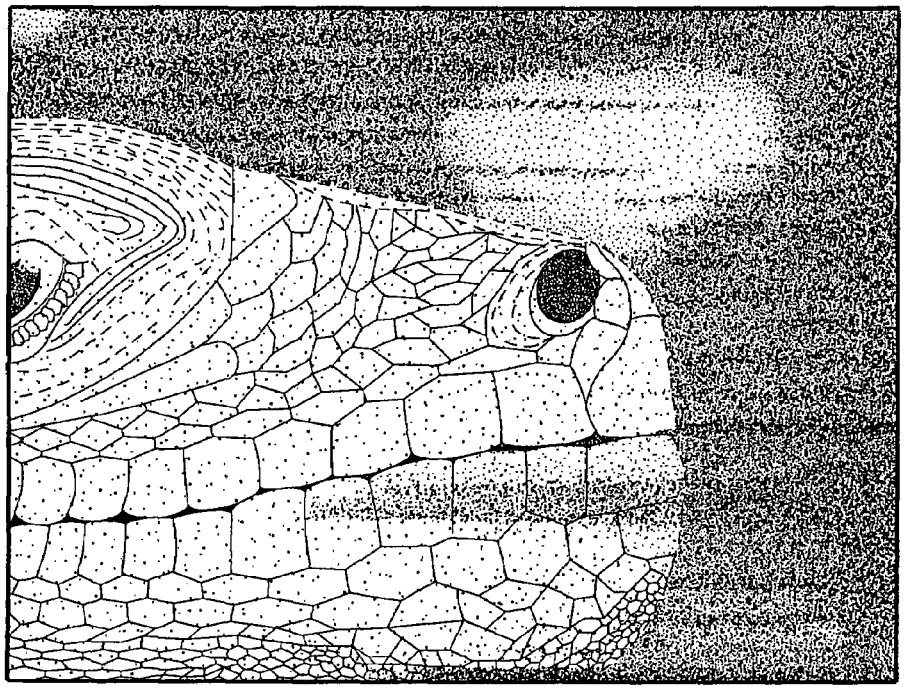
Figure 8B:
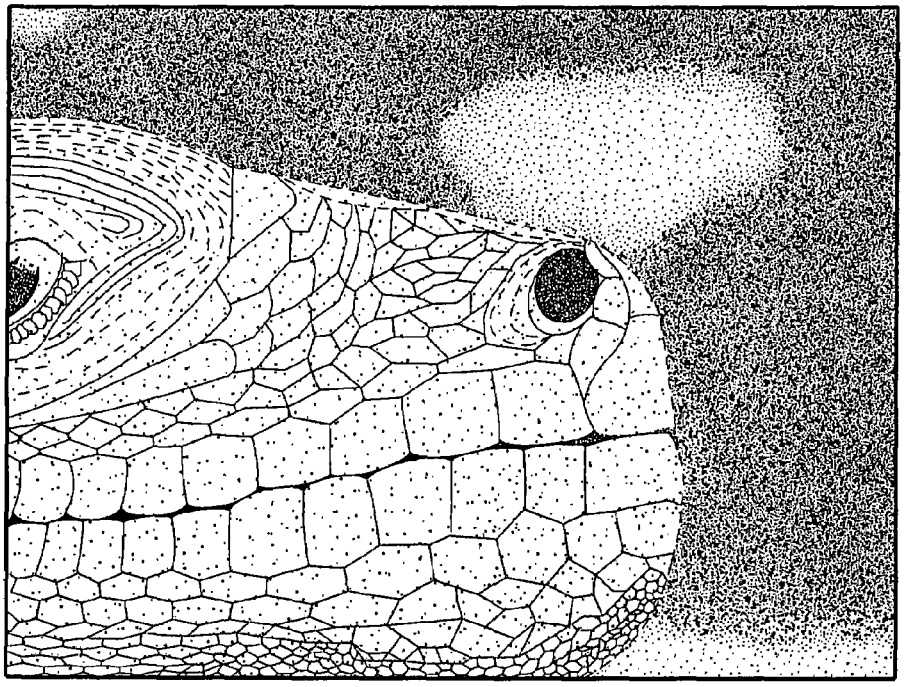

FIGS. 8A and 8B show a comparative example using drawing representations of a color image respectively rendered using a multipass technique of the prior art and the more robust multipass method in accordance with the present invention. The improvement resulting from the present is believed better seen using the drawing representations of the color images. Both color images were printed on a Chromaprint® 22UV printer sold by E.I. du Pont de Nemours and Company using an eight-pass printing mode, corresponding to Y-interlace of four ($P_V$=4) and an X-interlace of two ($P_H$=2). The print head contains one hundred eighty (180) nozzles and uses seven color inks, viz., black, white, yellow, cyan, light cyan, magenta, and light magenta.

In prior art technique of the drawing representation of FIG. 8A, where the number of print locations from nozzle-to-nozzle was a constant, banding was clearly seen as streaks of different gloss across the image. The banding was perhaps most pronounced in the lower right quadrant and in the upper central regions of the image. In the drawing representation of FIG. 8B the same image was printed under the same conditions but using the robust method of the present invention with a B-spline of order j=1 ($P_H$=2). Using the method of the present invention banding in the identified regions was greatly reduced.

Figure 9A:
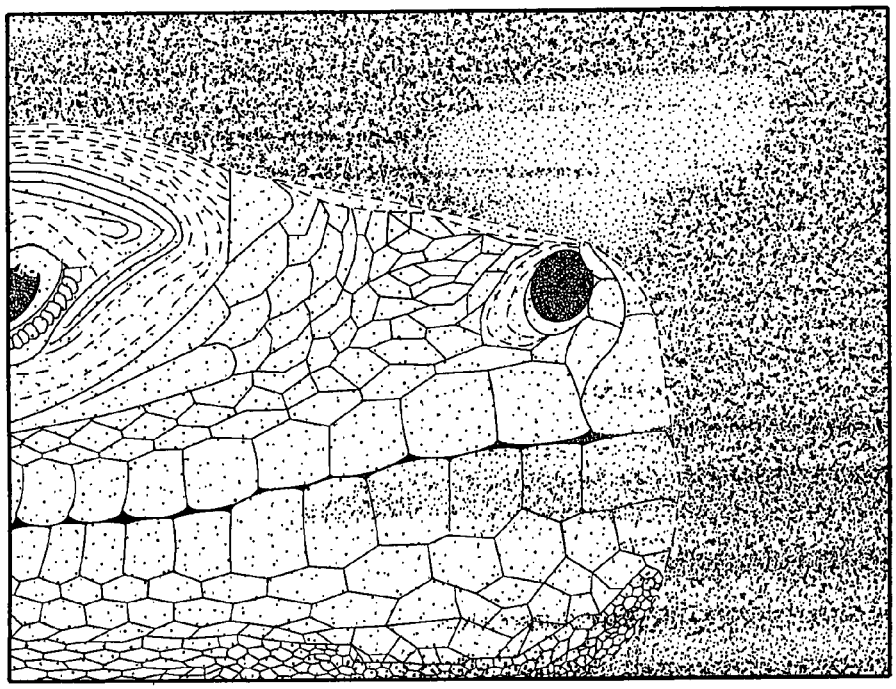
FIGS. 9A and 9B are drawing representations of black and white renditions of the color images of FIGS. 8A and 8B, respectively.
Figure 9B:
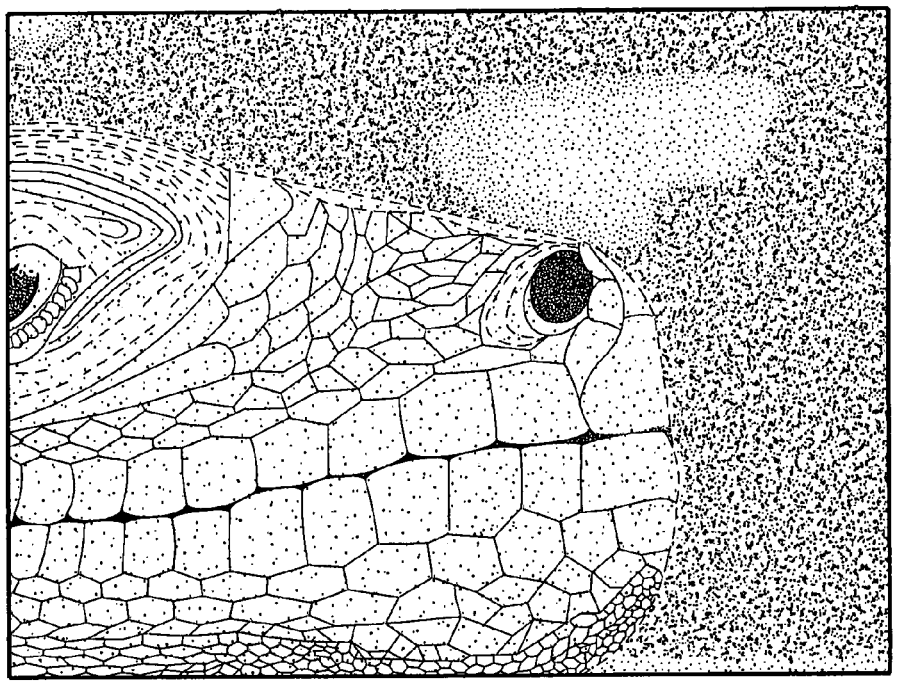

FIGS. 9A and 9B included herewith are drawing representations of black and white renditions of the color images of FIGS. 8A and 8B, respectively. Both the banding artifacts in corresponding regions and the conspicuous absence thereof are also visible in the drawing representations of FIGS. 9A and 9B.

Those skilled in the art, having the benefit of the teachings of the present invention may impart various modifications thereto. Such modifications are to be construed as lying within the contemplation of the present invention.

For example, the invention may be practiced by assigning to a nozzle a number of print locations that is substantially equal to the number of print locations mandated by the evaluation of Equation (10) and/or coming reasonably close to the requirement that all image-dictated print locations on a scan line receive an ink drop from a nozzle after all horizontal passes over that scan line are completed. That is to say, a multipass operation that allows small deviations from the number of print locations mandated by the appropriate sampled curve for any nozzle, and/or fills substantially all of the required print locations may nevertheless produce improved image quality when factors such as quality of ink, nature of substrate, resolution of the print head, viewer subjectivity, among others, are considered. So long as the number of print locations varies from nozzle-to-nozzle such practices are to be construed as lying within the scope of the present invention.

What is claimed is:

1. A printing apparatus for printing a substrate by depositing printing ink thereon, the apparatus comprising:

a transport for incrementally advancing a substrate to predetermined printing positions disposed along a path of travel;

a print head having a predetermined nozzle length $L_H$ and having N print nozzles therein;

a carriage for passing the print head in a direction oriented substantially transversely to the path of travel so that on any one pass each of the N nozzles in the print head each addresses a plurality of print locations disposed along a scan line defined on the substrate; and a computer-implemented controller for actuating, on each pass across any given scan line, some subset $P_H$ of the N nozzles to deposit a printing medium on a predetermined plurality Q of selected print locations on that given scan line, wherein the number $Q_n$ of selected print locations onto which a printing medium is deposited on any given scan line by the n-th one of the N print nozzles varies from nozzle to nozzle along substantially the entire length $L_H$ of the print head.

2. The apparatus of claim 1 wherein the nozzle-to-nozzle variation in the number $Q_n$ is defined substantially in accordance with a weighted smoothing spline function.

3. The apparatus of claim 2 wherein the weighted smoothing spline function is a polynomial B-spline function of the order "j", where j=($P_H$−1).

4. The apparatus of claim 2 wherein the number $Q_n$ of selected print locations onto which printing ink is deposited by the n-th one of the nozzles is substantially equal to the value for that number n of a weighted smoothing polynomial B-spline function of the order "j" of the following form, where j=($P_H$−1)

$$Q_n = \sum_{i=0}^{P_H} \frac{(-1)^i}{(P_H-1)!}\binom{P_H}{i}\left(\frac{n+\frac{P_H-N}{2}}{\frac{N}{P_H}}-i\right)^{P_H-1}\cdot U\left[\left(\frac{n+\frac{P_H-N}{2}}{\frac{N}{P_H}}-i\right)\right]$$

and wherein substantially all of the print locations $Q_n$ on a scan line are filled after $P_H$ number of passes over that scan line.

* * * * *